US009874355B2

(12) United States Patent
Green et al.

(10) Patent No.: US 9,874,355 B2
(45) Date of Patent: Jan. 23, 2018

(54) COOKTOP FOR GAS APPLIANCE

(71) Applicant: Electrolux Home Products, Inc., Charlotte, NC (US)

(72) Inventors: Daniel Green, Charlotte, NC (US); John Wilcox, Goodlettsville, TN (US); Scott Speck, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 804 days.

(21) Appl. No.: 13/912,871

(22) Filed: Jun. 7, 2013

(65) Prior Publication Data

US 2013/0327314 A1 Dec. 12, 2013

Related U.S. Application Data

(60) Provisional application No. 61/657,323, filed on Jun. 8, 2012.

(51) Int. Cl.
*F24C 15/10* (2006.01)

(52) U.S. Cl.
CPC ..... *F24C 15/10* (2013.01)

(58) Field of Classification Search
CPC ..... F24C 15/10
USPC ..... 126/39 B, 214 R
See application file for complete search history.

(56) References Cited

U.S. PATENT DOCUMENTS 2,429,279 A * 10/1947 Salter ..... F24C 15/10 126/214 R
2,713,862 A 7/1955 Chase
3,330,204 A 7/1967 Little
(Continued)

FOREIGN PATENT DOCUMENTS

CH 306009 3/1955
EP 583555 2/1994
(Continued)

OTHER PUBLICATIONS

JP 2005291583 A Machine Translation, accessed by Examiner on Feb. 19, 2016; http://translationportal.epo.org/emtp/translate/?ACTION=description-retrieval&COUNTRY=JP&ENGINE=google&FORMAT=docdb&KIND=A&LOCALE=en_EP&NUMBER=2005291583&OPS=jp.espacenet.com/ops&SRCLANG=ja&TRGLANG=en.*
(Continued)

*Primary Examiner* — Avinash Savani
(74) *Attorney, Agent, or Firm* — Pearne & Gordon LLP

(57) ABSTRACT

A cooking appliance includes a cooktop and a grate. The cooktop includes a bottom surface on which at least one gas burner is mounted. The cooktop further includes a periphery and an inner recessed area. The inner recessed area is recessed relative to the periphery. The inner recessed area is substantially defined by the bottom surface. The cooktop further includes a transition extending between the periphery and the inner recessed area and a sweep section extending between the periphery and the inner recessed area. The inner recessed area is surrounded substantially by the transition except at the sweep section. The grate is configured to be placed on the cooktop. Each of the sweep section and the transition extends between the bottom surface and a predetermined elevation above the bottom surface. The sweep section reaches the predetermined elevation in a more gradual manner than the transition reaches the predetermined elevation.

16 Claims, 3 Drawing Sheets

(56) References Cited

U.S. PATENT DOCUMENTS

| | | | | | |
|---|---|---|---|---|---|
| 4,119,021 | A * | 10/1978 | Moses | A47J 37/067 | 126/215 |
| 4,593,677 | A * | 6/1986 | Sargunam | F24C 15/10 | 126/211 |
| 5,372,121 | A * | 12/1994 | Castillo | F24C 15/10 | 126/214 R |
| 7,363,923 | B2 * | 4/2008 | Czajka | F24C 15/14 | 126/39 B |
| 2006/0016348 | A1 * | 1/2006 | Babington | A47J 37/0781 | 99/422 |
| 2014/0263276 | A1 * | 9/2014 | Harward | F24C 15/108 | 219/454.12 |

FOREIGN PATENT DOCUMENTS

| | | | | |
|---|---|---|---|---|
| EP | 0583555 | A1 * | 2/1994 | F24C 3/085 |
| JP | S5667047 | | 6/1981 | |
| JP | 2005291583 | | 10/2005 | |
| JP | 2005291583 | A * | 10/2005 | |
| WO | 03060383 | | 7/2003 | |
| WO | 2008104832 | | 9/2008 | |

OTHER PUBLICATIONS

Tsutomu Machine Translation; Accessed by Examiner on Jul. 18, 2016; https://www4.j-platpat.inpit.go.jp/cgi-bin/tran_web_cgi_ejje?u=http://www4.j-platpat.inpit.go.jp/eng/translation/201607190803382879837865412161240A8EF62545304EBE275E35EFB77177D8A.*

International Search Report for PCT/US2013/044777, dated Aug. 28, 2013, 3 pages.

* cited by examiner

COOKTOP FOR GAS APPLIANCE

This application claims the benefit of U.S. Provisional Patent Application No. 61/657,323 filed on Jun. 8, 2012, the entire disclosure of which is hereby incorporated herein by reference.

TECHNICAL FIELD

The present disclosure relates to a cooking appliance and, more particularly, to apparatuses and methods for cleaning a cooking appliance.

BACKGROUND

Certain cooking appliances are provided with a cooktop that has one or more burners for heating kitchen utensils. In certain types of burners, the burner projects from a surface on which the burner is mounted and food particles, dust or the like that fall onto the surface need to be removed therefrom. However, the geometry of the cooktop may make it difficult to remove gathered food particles from the surface. Specifically, the cooktop may have a recessed surface which may make it difficult to extract the food particles even after they are gathered.

SUMMARY

In a first example, a cooking appliance includes a cooktop and a grate. The cooktop includes a bottom surface on which at least one gas burner is mounted. The cooktop further includes a periphery and an inner recessed area. The inner recessed area is substantially defined by the bottom surface. The at least one gas burner is mounted on the inner recessed area. The cooktop further includes a transition extending between the periphery and the inner recessed area and a sweep section extending between the periphery and the inner recessed area. The inner recessed area is surrounded substantially by the transition except at the sweep section. The grate is configured to be placed on the cooktop. The sweep section extends between the bottom surface and a predetermined elevation which is on the periphery and is above the bottom surface. The transition extends between the bottom surface and the predetermined elevation. The sweep section is defined by a continuous surface and reaches the predetermined elevation in a more gradual manner than the transition reaches the predetermined elevation.

In one example aspect of the first example, the periphery includes an outer recessed area, and the outer recessed area is recessed relative to the periphery.

In another example aspect of the first example, the transition extends from the bottom surface to the outer recessed area between the bottom surface and the predetermined elevation, and the sweep section extends from the bottom surface to the outer recessed area between the bottom surface and the predetermined elevation.

In yet another example aspect of the first example, the periphery substantially surrounds the outer recessed area which substantially surrounds the inner recessed area.

In yet another example aspect of the first example, the grate is configured to be placed on the outer recessed area.

In yet another example aspect of the first example, the continuous surface forms a discontinuity in the outer recessed area.

In yet another example aspect of the first example, the discontinuity in the outer recessed area is concealed at least partially by the grate.

In yet another example aspect of the first example, the cooktop is substantially rectangular such that the periphery includes a proximal edge, a distal edge and lateral edges, and the sweep section intersects the proximal edge.

In a second example, a cooking appliance includes a cooktop and a grate. The cooktop includes a bottom surface on which at least one gas burner is mounted. The cooktop further includes a periphery and an inner recessed area. The inner recessed area is recessed relative to the periphery. The inner recessed area is substantially defined by the bottom surface. The cooktop further includes a transition extending between the periphery and the inner recessed area and a sweep section extending between the periphery and the inner recessed area. The inner recessed area is surrounded substantially by the transition except at the sweep section. A grate is configured to be placed on the cooktop. The sweep section extends between the bottom surface and a predetermined elevation which is on the periphery and is above the bottom surface. The transition extends between the bottom surface and the predetermined elevation. A cross-section of the sweep section is concavely curved. A cross-section of the transition is concavely curved. A radius of curvature of the sweep section is larger than a radius of curvature of the transition.

In one example aspect of the second example, the periphery includes an outer recessed area, and the outer recessed area is recessed relative to the periphery.

In another example aspect of the second example, the transition extends from the bottom surface to the outer recessed area between the bottom surface and the predetermined elevation. The sweep section extends from the bottom surface to the outer recessed area between the bottom surface and the predetermined elevation.

In yet another example aspect of the second example, the periphery substantially surrounds the outer recessed area which substantially surrounds the inner recessed area.

In yet another example aspect of the second example, the grate is configured to be placed on the outer recessed area.

In yet another example aspect of the second example, the continuous surface forms a discontinuity in the outer recessed area.

In yet another example aspect of the second example, the discontinuity in the outer recessed area is concealed at least partially by the grate.

In yet another example aspect of the second example, the cooktop is substantially rectangular such that the periphery includes a proximal edge, a distal edge and lateral edges, and the sweep section intersects the proximal edge.

BRIEF DESCRIPTION OF THE DRAWINGS

These and other aspects are better understood when the following detailed description is read with reference to the accompanying drawings, in which.

DETAILED DESCRIPTION

Figure 1:
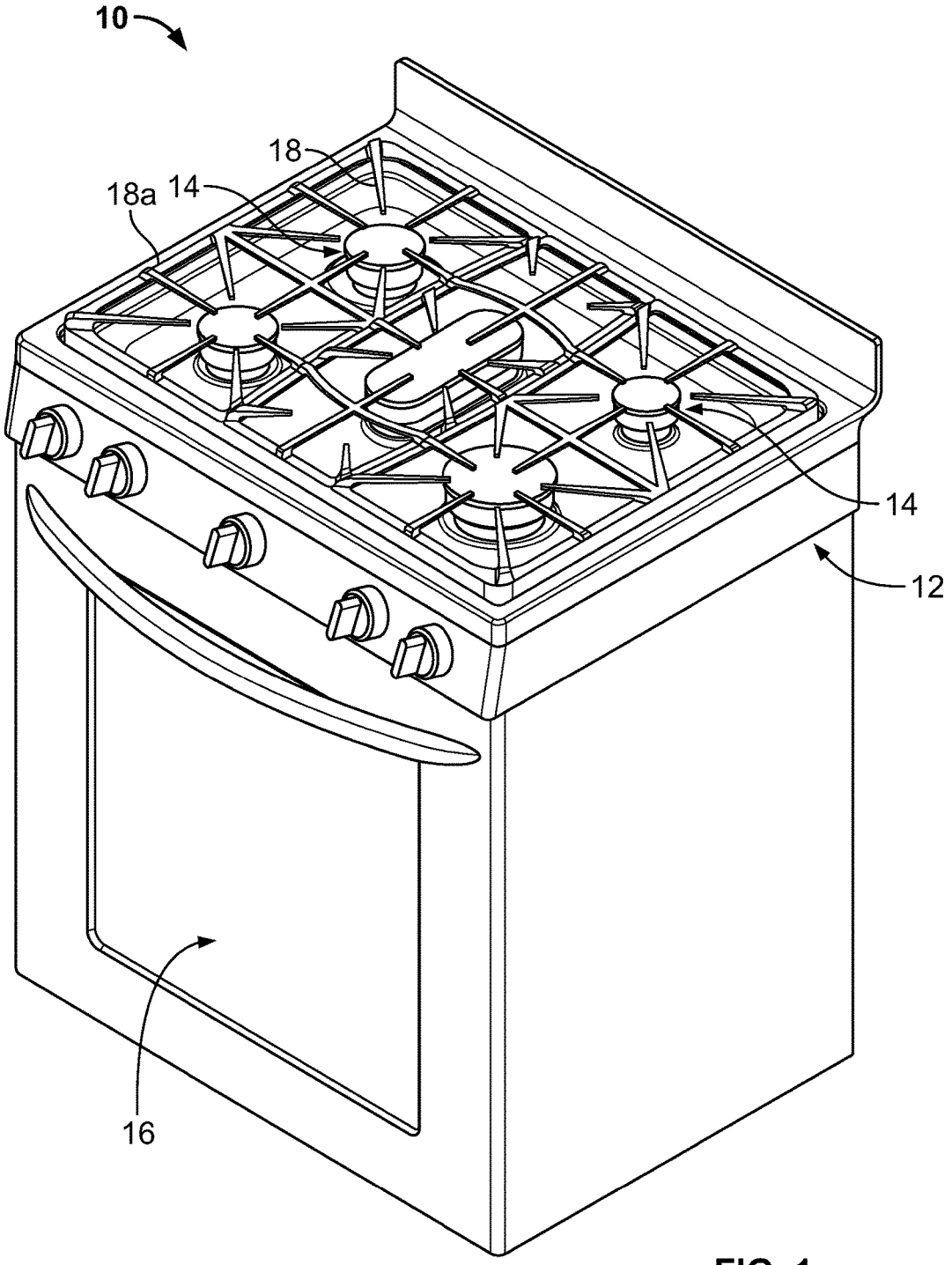
FIG. 1 is a view of an example embodiment of a cooking appliance including an example cooktop with an example grate placed thereon.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example embodiment of a cooking appliance implemented with the features described below is illustrated. In the present embodiment, the cooking appliance 10 is a kitchen stove including a cooktop 12 with a set of burners 14 and an oven 16 below the cooktop 12. A grate 18 may be mounted on the cooktop 12 to allow cooking utensils to be placed above the burners 14 to be heated thereon. However, the kitchen stove may of various types such as slide-in, freestanding, etc. or, alternatively, the cooking appliance may be embodied in a significantly different configuration (e.g., a portable stove with a single burner on the cooktop and without an oven).

Figure 2:
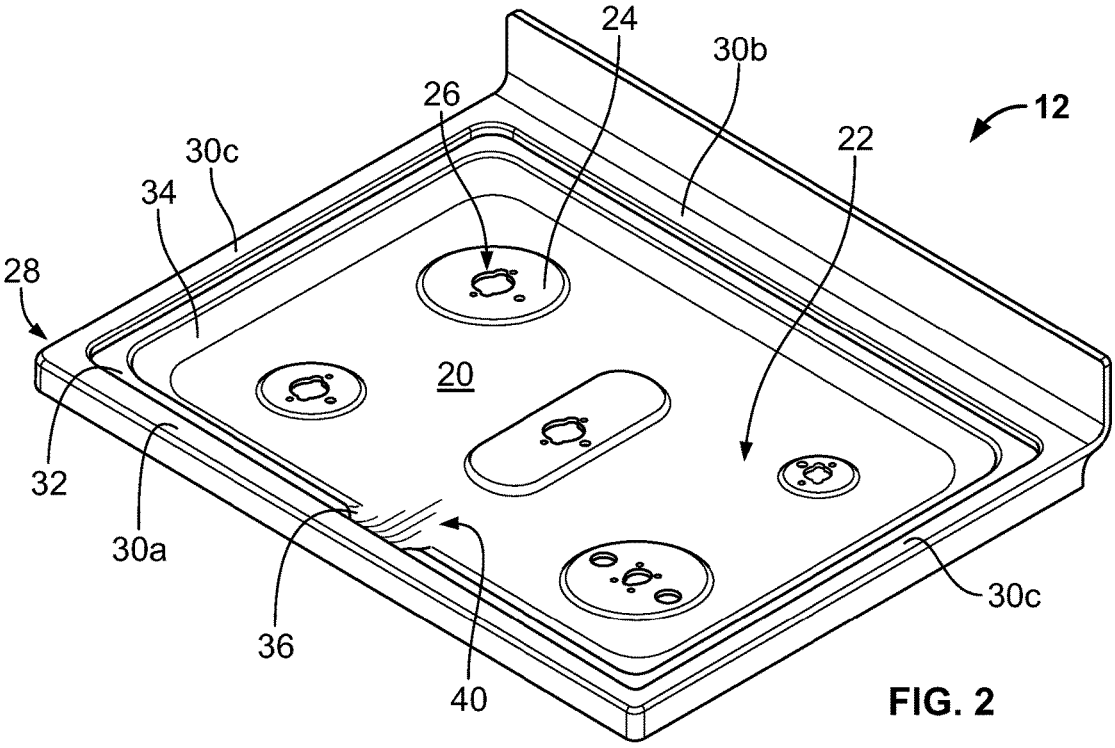
FIG. 2 is a front perspective view of the example cooktop in FIG. 1 in an isolated state.
Figure 3:
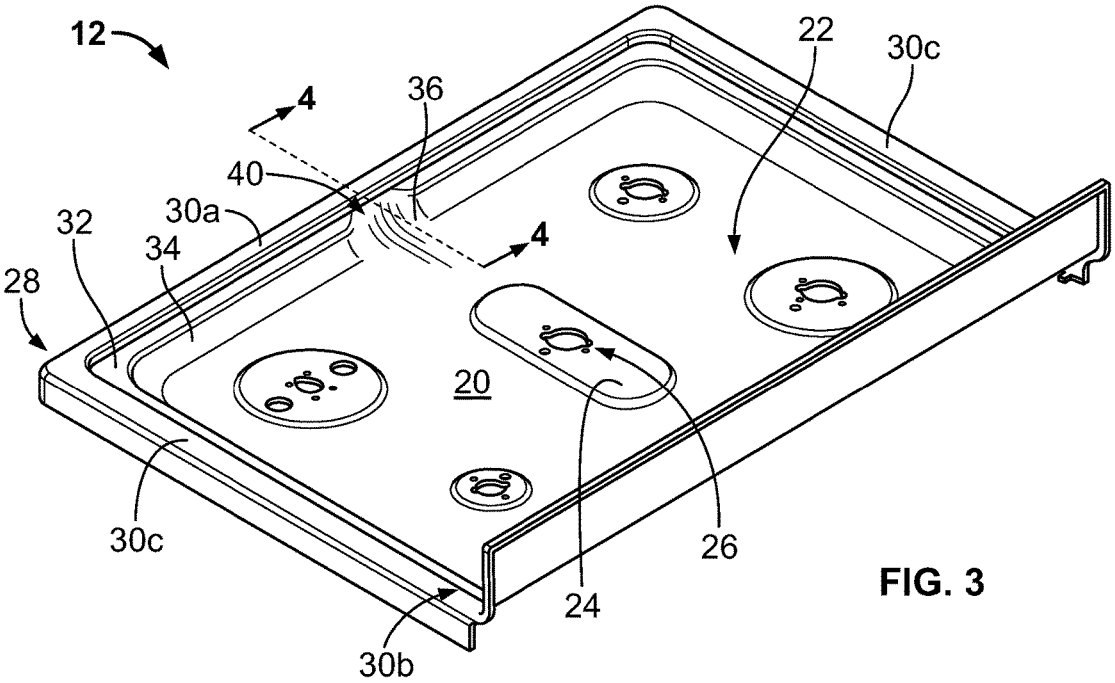
FIG. 3 is a rear perspective view of the example cooktop in an isolated state.

The cooking appliance 10 may provide heat using combustible gas and the cooktop 12 may include one or more gas burners 14 that are mounted on a bottom surface 20 of the cooktop 12. As shown in FIGS. 2-3, in the present embodiment, the cooktop 12 includes an inner recessed area 22 and the bottom surface 20 substantially defines the inner recessed area 22. The bottom surface 20 may be substantially flat but may include a plurality of areas that has raised portions 24 and apertures 26 such that the gas burners 14 can be mounted thereat. A periphery 28 of the cooktop 12 may have a substantially rectangular shape so as to include a front proximal edge 30*a*, a rear distal edge 30*b*, and lateral edges 30*c*. The periphery 28 may be formed to include an outer recessed area 32 that is recessed relative to the periphery 28 and the inner recessed area 22 may be recessed relative to the outer recessed area 32. The periphery 28 and the outer recessed area 32 may also be substantially flat. Moreover, the periphery 28 may substantially surround the outer recessed area 32 while the outer recessed area 32 may substantially surround the inner recessed area 22. Thus, the inner recessed area 22 may take up the majority of a top surface of the cooktop 12 while the outer recessed area 32 and the periphery 28 are provided on the outskirts of the bottom surface 20. The grate 18 may be placed on the cooktop 12 and may provide member-like features to support the kitchen utensils. The grate 18 may include an outer frame 18*a* that is shaped to be supported primarily by the outer recessed area 32.

Figure 4:
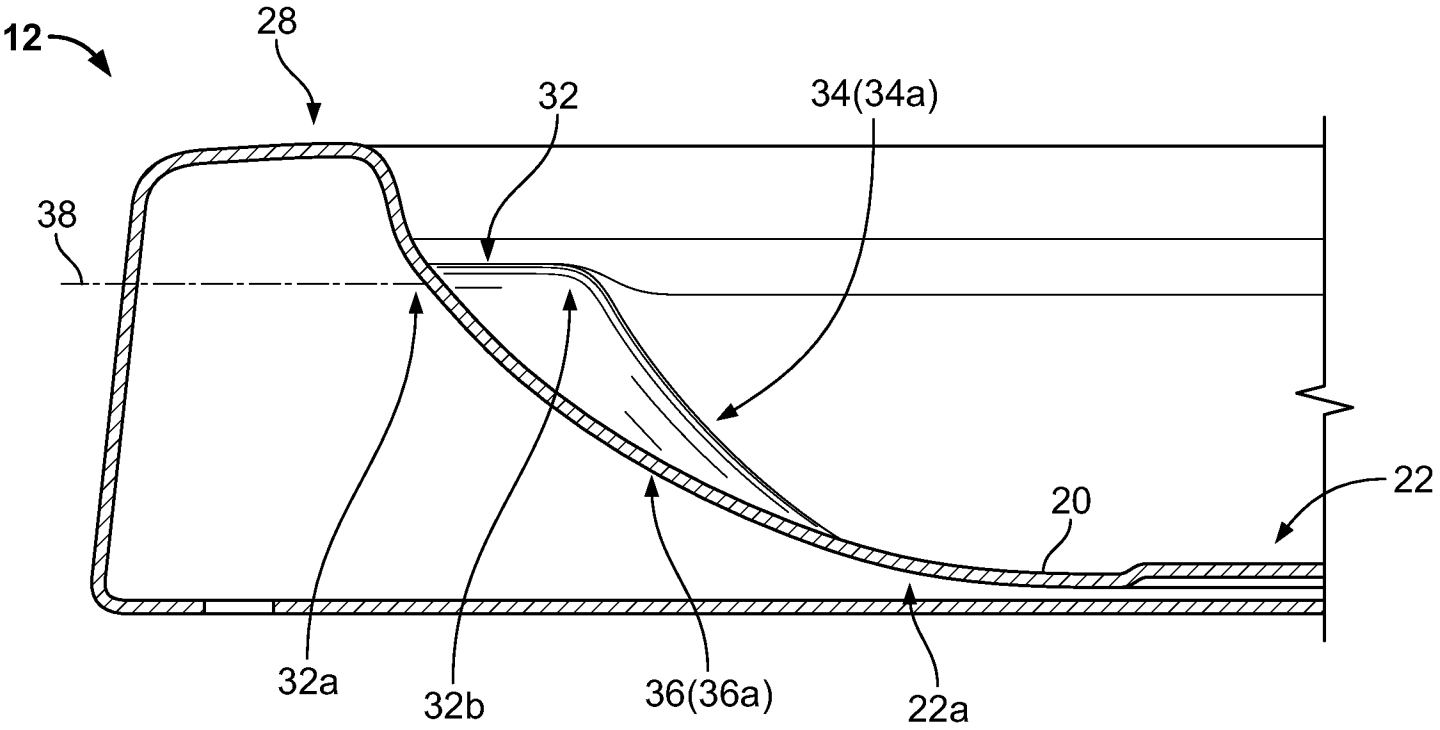
FIG. 4 is a cross-sectional view of the example cooktop cut across a sweep section of the cooktop.

The inner recessed area 22 may be substantially surrounded by a transition 34 except at a sweep section 36 as shown in FIGS. 2-3. The transition 34 may be a substantially slanted surface that is linear, curvilinear or a combination of both configuration and extends between the inner recessed area 22 and the periphery 28 along the majority of the periphery 28. As shown in FIG. 4, the transition 34 may be embodied as a concavely curved surface 34*a*. The sweep section 36 may also be a substantially slanted surface that is linear, curvilinear or a combination of both configuration and extends between the inner recessed area 22 and the periphery 28. In one embodiment, the sweep section 36 may be defined by a continuous, concavely curved surface 36*a* as shown in FIG. 4. Both the transition 34 and the sweep section 36 may extend vertically from the bottom surface 20 to a predetermined elevation 38 above the bottom surface 20. The predetermined elevation 38 may correspond to a level at which a part of the periphery 28 is located and possibly to the level of the plane over which the outer recessed area 32 extends. Thus, the sweep section 36 may extend horizontally from the bottom surface 20 to the outer recessed area 32 vertically between the bottom surface 20 and the predetermined elevation 38 while the transition 34 may extend horizontally from the bottom surface 20 to the inner recessed area 22 vertically between the bottom surface 20 and the predetermined elevation 38. However, while the sweep section 36 and the transition 34 may extend over the same distance in a vertical direction or in height, the sweep section 36 may extend over a longer distance than the transition 34 in a horizontal direction or in length as shown in FIG. 4. The sweep section 36 may extend from an outer portion 22*a* of the inner recessed area 22 to an outer portion 32*a* of the outer recessed area 32 while the transition 34 may extend from an outer portion 22*a* of the inner recessed area 22 to an inner portion 32*b* of the outer recessed area 32 as shown in FIG. 4. In case both the sweep section 36 and the transition 34 are concavely curved, such a configuration may result in the radius of curvature of the sweep section 36 being larger than the radius of curvature of the transition 34. As a result, the sweep section 36 reaches the predetermined elevation 38 in a more gradual manner than the transition 34 reaches the predetermined elevation 38.

The sweep section 36 may be formed to intersect one of the edges of the periphery 28 as shown in FIG. 3 such that the inner recessed area 22 is substantially surrounded by the transition 34 except at the sweep section 36. In the present embodiment, the sweep section 36 is formed to intersect the proximal edge 30*a* of the periphery 28 and the presence of the sweep section 36 on the cooktop 12 creates a discontinuity 40 in the outer recessed area 32 as shown in FIGS. 2-3. However, the discontinuity 40 may be at least partially concealed by the grate 18 when it is placed on the outer recessed area 32 such that the aesthetics of the cooktop 12 is not significantly affected by the sweep section 36.

The sweep section 36 may facilitate cleaning of the cooktop 12 by allowing food particles to be removed using the sweep section 36. Specifically, the food particles may be gathered and removed of the bottom surface 20 by wiping the particles out of the inner recessed area 22 along sweep section 36 using a piece of cloth or the like. Without the sweep section 36, the cross-sectionally stepped configuration around the inner recessed area 22 due to the presence of the outer recessed area 32 would make it difficult to remove the food particles in this manner.

It will be apparent to those skilled in the art that various modifications and variations can be made without departing from the spirit and scope of the claimed apparatus or method.

What is claimed is:

1. A cooking appliance including:

a cooktop including a bottom surface on which a plurality of gas burners is mounted, the cooktop further including a periphery defining a perimeter of the cooktop and an inner recessed area, the inner recessed area substantially defined by the bottom surface, the plurality of gas burners mounted on the inner recessed area, the cooktop further including a gradual transition extending between the periphery and the inner recessed area and a sweep section extending between the periphery and the inner recessed area, the inner recessed area surrounded substantially by the transition except at the sweep section; and a grate configured above one or more burners, wherein the sweep section extends between the bottom surface and a predetermined elevation which is on the periphery and is above the bottom surface, the transition extends between the bottom surface and the predetermined elevation, and the sweep section is defined by a continuous surface and reaches the predetermined elevation in a more gradual manner than the transition reaches the predetermined elevation.

2. The cooking appliance of claim 1, wherein the periphery includes an outer recessed area, and the outer recessed area is recessed relative to the periphery.

3. The cooking appliance of claim 2, wherein the transition extends from the bottom surface to the outer recessed area between the bottom surface and the predetermined elevation, and the sweep section extends from the bottom surface to the outer recessed area between the bottom surface and the predetermined elevation.

4. The cooking appliance of claim 2, wherein the periphery substantially surrounds the outer recessed area which substantially surrounds the inner recessed area.

5. The cooking appliance of claim 4, wherein the grate is placed on the outer recessed area.

6. The cooking appliance of claim 4, wherein the continuous surface forms a discontinuity in the outer recessed area.

7. The cooking appliance of claim 6, wherein the discontinuity in the outer recessed area is concealed at least partially by the grate.

8. The cooking appliance of claim 2, wherein the cooktop is substantially rectangular such that the periphery includes a proximal edge, a distal edge and lateral edges, and the sweep section intersects the proximal edge.

9. A cooking appliance including:

a cooktop including a bottom surface on which a plurality of gas burners is mounted, the cooktop further including a periphery defining a perimeter of the cooktop and an inner recessed area, the inner recessed area being recessed relative to the periphery, the inner recessed area substantially defined by the bottom surface, the cooktop further including a transition extending between the periphery and the inner recessed area and a sweep section extending between the periphery and the inner recessed area, the inner recessed area surrounded substantially by the transition except at the sweep section; and a grate configured to be placed on the cooktop, wherein the sweep section extends continuously from the bottom surface and a predetermined elevation which is on the periphery and is above the bottom surface, the transition extends between the bottom surface and the predetermined elevation, a cross-section of the sweep section is concavely curved, a cross-section of the transition is concavely curved, and a radius of curvature of the sweep section is larger than a radius of curvature of the transition.

10. The cooking appliance of claim 9, wherein the periphery includes an outer recessed area, and the outer recessed area is recessed relative to the periphery.

11. The cooking appliance of claim 10, wherein the transition extends from the bottom surface to the outer recessed area between the bottom surface and the predetermined elevation, and the sweep section extends from the bottom surface to the outer recessed area between the bottom surface and the predetermined elevation.

12. The cooking appliance of claim 10, wherein the periphery substantially surrounds the outer recessed area which substantially surrounds the inner recessed area.

13. The cooking appliance of claim 12, wherein the grate is placed on the outer recessed area.

14. The cooking appliance of claim 12, wherein the continuous surface forms a discontinuity in the outer recessed area.

15. The cooking appliance of claim 14, wherein the discontinuity in the outer recessed area is concealed at least partially by the grate.

16. The cooking appliance of claim 10, wherein the cooktop is substantially rectangular such that the periphery includes a proximal edge, a distal edge and lateral edges, and the sweep section intersects the proximal edge.

* * * * *